US006827112B2

(12) United States Patent
Lemmon

(10) Patent No.: US 6,827,112 B2
(45) Date of Patent: Dec. 7, 2004

(54) SYSTEM AND METHOD FOR CONTROLLING A HAZARDOUS FLUID DISTRIBUTION FACILITY

(76) Inventor: Tracey T. Lemmon, 2678 Youngs Grove Rd., Columbus, OH (US) 43231

( * ) Notice: Subject to any disclaimer, the term of this patent is extended or adjusted under 35 U.S.C. 154(b) by 31 days.

(21) Appl. No.: 10/686,244

(22) Filed: Oct. 15, 2003

(65) Prior Publication Data

US 2004/0074559 A1 Apr. 22, 2004

Related U.S. Application Data

(62) Division of application No. 10/000,068, filed on Dec. 4, 2001, now Pat. No. 6,698,463.

(51) Int. Cl.[7] ..... B65B 1/04; B65B 3/04; B67C 3/02

(52) U.S. Cl. ..... 141/98; 141/51; 141/94; 141/197; 141/285; 141/DIG. 2

(58) Field of Search ..... 141/1, 3, 4, 11, 141/44, 47, 51, 83, 94, 95, 98, 192, 197, 285, DIG. 2; 137/456, 487.5, 885

(56) References Cited

U.S. PATENT DOCUMENTS 4,424,438 A * 1/1984 Antelman et al. ..... 219/491
5,231,796 A * 8/1993 Sims ..... 43/124
5,263,824 A * 11/1993 Waldbeser et al. ..... 417/10
5,586,050 A * 12/1996 Makel et al. ..... 702/51
5,694,960 A * 12/1997 Turk et al. ..... 137/1
5,823,235 A * 10/1998 Alley et al. ..... 141/197
5,921,266 A * 7/1999 Meyer ..... 137/68.14
5,927,316 A * 7/1999 Merrill ..... 137/68.14
5,975,160 A * 11/1999 Rush ..... 141/192
6,123,093 A * 9/2000 D'Antonio et al. ..... 137/78.3
6,698,463 B2 * 3/2004 Lemmon ..... 141/4

* cited by examiner

*Primary Examiner*—Timothy L. Maust
(74) *Attorney, Agent, or Firm*—Mueller & Smith, IPA

(57) ABSTRACT

System for controlling a hazardous fluid distribution facility wherein a control arrangement is provided at the facility having a power on switch providing for its general energization and de-energization along with a start switch which is actuated by an operator for an interval of time sufficient for a gas pressure control monitor to assume an enable condition causing the actuation of tank valves and the enablement of emergency shut-off valves. A receiver is incorporated with the housing which performs in conjunction with strategically positioned emergency transmitters which are actuated by personnel in the event of a perceived emergency condition. The transmitters transmit an off-state signal which is responded to by the receiver circuit to vent the pneumatic actuation and enablement system as well as to disenable electrical input to pump motors. The transmitters are polled periodically by the receiver circuit to determine their operational status.

14 Claims, 11 Drawing Sheets

SYSTEM AND METHOD FOR CONTROLLING A HAZARDOUS FLUID DISTRIBUTION FACILITY

CROSS-REFERENCE TO RELATED APPLICATIONS

This application is a division of U.S. application for patent Ser. No. 10/000,068, filed Dec. 04, 2001, now U.S. Pat. No. 6,698,463.

STATEMENT REGARDING FEDERALLY SPONSORED RESEARCH

Not applicable.

BACKGROUND OF THE INVENTION

The properties of liquefied petroleum (LP) gases and other hazardous materials are described in the standard of the National Fire Protection Association (NFPA) as products which are gases at normal room temperature and atmospheric pressure. They liquefy under moderate pressure, readily vaporizing upon release of the pressure. The potential fire hazard of LP-Gas vapor is comparable to that of natural or manufactured gas and their ranges of flammability are considerably narrower and lower. For example, the lower flammable limits of the more commonly used LP-Gases are 2.15% for propane and 1.55% for butane, those values representing volumetric percentages of gas in gas-air mixtures. See: ANSI/NFPA 58.

The commercial distribution of these liquefied gases from major production facilities, particularly in the case of propane, involves the utilization of stationary distribution installations or "plants" which may serve a single industrial complex or a wide range of smaller customers located within a practical product transportation range, for instance, about forty miles. Typically, transport from the production facilities to the distribution plant is by semi-truck implemented transporters having about a 10,000 gallon tank capacity.

The layouts of the distribution facilities vary considerably depending upon the needs of the locally served market. Such distribution facilities generally are climatically open fenced-in regions within which one or several steel stationary tanks, typically having a capacity of 30,000 gallons or 18,000 gallons, are supported upon concrete cradles. Those cradles are designed to accommodate for temperature induced tank contraction and expansion. These steel tanks are fabricated under American Society of Mechanical Engineers (ASME) published specifications. The noted larger capacity transporter vehicles periodically off-load the hazardous liquid product into these tanks utilizing a somewhat well established procedure. In this regard, spaced about five to ten feet from the tanks are one to several concrete or steel supported stanchions supporting conduits, valves and the like extending to the stationary tank through which product is pumped from the transporter. Such valves include a fire valve located at the bottom of the tank communicating with its liquid region and having a fuzable link which releases a spring valve closure mechanism at temperatures above 212° F. Also incorporated within the system are excess flow valves designed to close when the liquid passing through them exceeds the prescribed flow rate as determined by pressure drop. These valves assume an open state upon fluid delivery into the stationary tanks and will close in the event product is inadvertently released. The fire valves may be opened manually, or by using explosion-proof solenoid actuators or, more typically, utilizing a pneumatic system which, when pressured with gaseous nitrogen, causes the valve to open and to dose automatically under spring bias with loss of such pressure. Piping extends from these valves to flow control valving adjacent the stanchions which, in turn, are connected in fluid transfer relationship with the trailer born transporter tanks. During a loading procedure, vapor equalization conduits are coupled to extend between the vapor regions of the stationary tank and the transporter tank.

The most prevalent off-loading from the stationary tank is into smaller distribution trucks having frame-mounted smaller tanks. Such delivery vehicles are referred to as "bobtails". To carry out the product loading of a bobtail, the vehicle is parked adjacent to a stanchion. A pneumatically enabled emergency shut-off valve (ESV) is mounted at the stanchions which is in fluid communication with an electric motor driven pump which, in turn, is coupled in fluid transfer relationship with one of the above-noted fire valves. Upon coupling the bobtail tank with the stationary tank at the stanchion, the motor activated pump is energized and the ESV valve is opened. The ESV valve will remain open as long as pneumatic pressure is present. However, with the loss of such pressure, the valve is spring biased to close. In general, the explosion proof pump motors are energized from induction starters located quite remotely from the stationary tanks. Accordingly, it is necessary for the fire valves to be opened and the motors enabled as well as the pneumatic system as part of the procedure for loading the bobtails. While some of the distribution facilities will be quite elaborate, incorporating satellite loading components for filling variety of steel containers ranging from small portable cylinders to skid mounted larger tanks, in many instances the plants are unattended, accidents must be anticipated. Where dangerous incidences do occur, then it is appropriate for personnel to exit the region forthwith, a proper procedure, but one which may leave the distribution facility in a perilous condition. Many of these distribution facilities are substantially un-manned. As a consequence the bobtail driver or transport operator must open and activate the facility as well as close and de-activate it For instance the bobtail driver is called upon to activate the pneumatic system to open an appropriate fire valve, energize an appropriate pump motor through the remote starters and then reverse the procedure upon completion of filling, whereupon the bobtail exits the plant. Calling upon the delivery truck drivers to carry out these procedures is not considered desirable and, accordingly, many truck mounted safety features have been mandated by regulatory authorities.

BRIEF SUMMARY OF THE INVENTION

The present invention is addressed to a system and method for controlling a distribution facility for hazardous including combustible fluids such as propane. With the system, an operator, upon entering the facility, prepares it for either filling a distribution tank or supplying the facility with fluid by actuating a housing mounted power switch from an off to an on condition. Then the operator depresses a start of reset switch for an interval sufficient to pressurize the pneumatic system of the facility, typically an interval amounting to about 1 to 15 seconds. The facility then is ready for the carrying out of distribution tank filling or storage tank supply procedures. At the completion of such a distribution or supply activity, the operator, upon disconnecting from the facility, simply returns to the remotely disposed housing and activates the power switch from its on-state to its off-state. This causes the complete shut-down of the system including the closing of tank valves, removal of enabling pneumatic pressures from emergency shut-off valves, and the disenablement of electric pump components.

As another feature of the invention, the control system incorporates a receiver at the noted housing which responds to emergency shut-off transmission broadcast from strategically positioned transmitters. In the event of a perceived emergency, personnel, upon rapidly leaving the facility will encounter simply activated shut-down switches which cause the transmitter to broadcast to the receiver causing the carrying out of the noted shut-down procedure automatically. The receiving circuit additionally polls the emergency transmitters to determine their operational status. In the event of a defective transmitter, a perceptible cue is energized and the defective transmitter is identified for correction.

The invention further features a method for controlling a hazardous fluid distribution facility having a perimeter with an entrance, an electrical power input, a source gas under pressure, a principal fluid storage tank, a tank valve pneumatically actuable to provide fluid flow communication with the principal storage tank and having a closed state in the absence of such actuation, a fluid pump in fluid flow communication with the tank valve, a motor coupled to drive the fluid pump when enabled and actuated, a fluid transfer station and a fill valve in fluid flow communication with the pump and connectible when pneumatically enabled and actuated in fluid delivery communication with a distribution tank, the fill valve having a closed state when pneumatically disenabled, comprising the steps of:

providing a power switch coupled with the electrical power input, the power switch being actuable to provide an electrical power output and an off condition;

providing a start switch coupled with the power switch and actuable to respond to the electrical power output to provide an on-state input;

providing an electrically controllable valve coupled in gas flow relationship between the source of gas under pressure and a gas conduit assembly extending to the tank valve and the fill valve, responsive to an on-state input to convey gas under pressure from the source into the gas conduit assembly and effecting a venting of the gas conduit assembly in the absence of the on-state input;

providing a gas pressure monitor responsive, when enabled, to the pressure of gas at the conduit assembly, having a system enable condition when the gas pressure is at an enable value and having an off condition when the gas pressure is lower than the enable value;

actuating the power switch to provide an electrical power output;

actuating the start switch to derive the on-state input and to enable the gas pressure monitor for an interval sufficient to derive the system enable condition effecting the pneumatic actuation of the tank valve and enablement of the fill valve and the motor;

actuating the motor and the fill valve and delivering fluid from the principal storage tank to the distribution tank; and then actuating the power switch to provide the off condition to effect the venting of the gas conduit assembly at the electrically controllable valve to in turn, effect the closed state at the tank valve, effect the disenablement of the fill valve, and effect disenablement of the gas pressure monitor and the motor.

As another feature, the invention provides a method for controlling a hazardous fluid distribution facility having a perimeter with an entrance, an electrical power input, a source of gas under pressure, a principal storage tank, a fluid tank valve pneumatically actuable to provide fluid flow communication with the principal tank and having a closed state preventing the fluid flow communication in the absence of the pneumatic actuation, a vapor tank valve pneumatically actuable to provide vapor communication with the principal storage tank and having a closed state preventing the vapor communication in the absence of the pneumatic actuation, a fluid shut-off valve actuable when pneumatically enabled to provide fluid flow communication with the principal storage tank through the fluid tank valve and having a closed state when pneumatically disenabled, a vapor shut-off valve actuable when pneumatically enabled to provide vapor communication with the principal storage tank through the vapor tank valve and having a closed state when pneumatically disenabled, a fluid transfer station adjacent the fluid shut-off valve and the vapor shut-off valve for receiving the combustible fluid from the pumped fluid output of the supply tank of a delivery vehicle located adjacent the fluid transfer station, the vehicle supply tank having a vent input, comprising the steps of:

providing a power switch in electrical communication with the electrical power input, the power switch being actuable to provide an electrical power output and an off condition;

providing a start switch in electrical communication with the power switch and actuable to respond to the electrical power output to provide a system start output;

providing an electrically controllable valve coupled in gas flow relationship between the source of gas under pressure and a gas conduit assembly extending to the fluid tank valve, the vapor tank valve, the fluid shut-off valve and the vapor shut-off valve, responsive to an on-state input to convey gas under pressure from the source into the gas conduit assembly and effecting a venting of the gas conduit assembly in the absence of the on-state input;

providing a gas pressure monitor responsive when enabled to the pressure of the gas at the conduit assembly, having a system enable condition when the gas pressure is at an enable value and having an off condition when the gas pressure is lower than the enable value;

actuating the power switch to provide the electrical power output;

actuating the start switch to derive the on-state output and to enable the gas pressure monitor for an interval sufficient to derive the system enable condition effecting the pneumatic actuation of the fluid tank valve and the vapor tank valve, and the enablement of the fluid shut-off valve and the vapor shut-off valve;

coupling the delivery vehicle supply tank pumped fluid output in fluid transfer relationship with the fluid shut-off valve;

coupling the delivery vehicle supply tank vent input with the vapor tank valve;

actuating the enabled fluid shut-off valve and the enabled vapor shut-off valve;

providing combustible fluid from the supply tank to the principal storage tank;

actuating the power switch to provide the off condition to effect the venting of the gas conduit assembly at the electrically controllable valve to, in turn, derive the closed state at the fluid tank valve and the vapor tank valve and to pneumatically disenable the fluid shut-off valve and the vapor shut-off valve;

decoupling the delivery vehicle supply tank pumped fluid output from the fluid shut-off valve; and decoupling the delivery vehicle supply tank vent input from the motor shut-off valve.

Other objects of the invention will, in part, be obvious and will, in part, appear hereinafter. The invention, accordingly, comprises the method and system possessing the construction, combination of elements, arrangement of parts, and steps which are exemplified in the following detailed description.

For a fuller understanding of the nature and objects of the invention, reference should be made to the following detailed description taken in connection with the accompanying drawings.

DETAILED DESCRIPTION OF THE INVENTION

In the discourse to follow, two salient aspects of the system and method of the invention are set forth. In one aspect, a control system and method is described which not only increases the safety but also improves the efficiency of day-to-day operations wherein distribution tanks are filled from principal storage tanks and wherein larger transporter vehicles are off-loading hazardous or combustible fluids to these principal fluid storage tanks. As a second aspect, the system and method incorporates strategically positioned emergency switches which transmit to a receiver within the control network functioning in turn, to cause a complete system shutdown in terms of both closing all strategic valves and terminating electrical power distribution to motor driven pumps.

Figure 1:
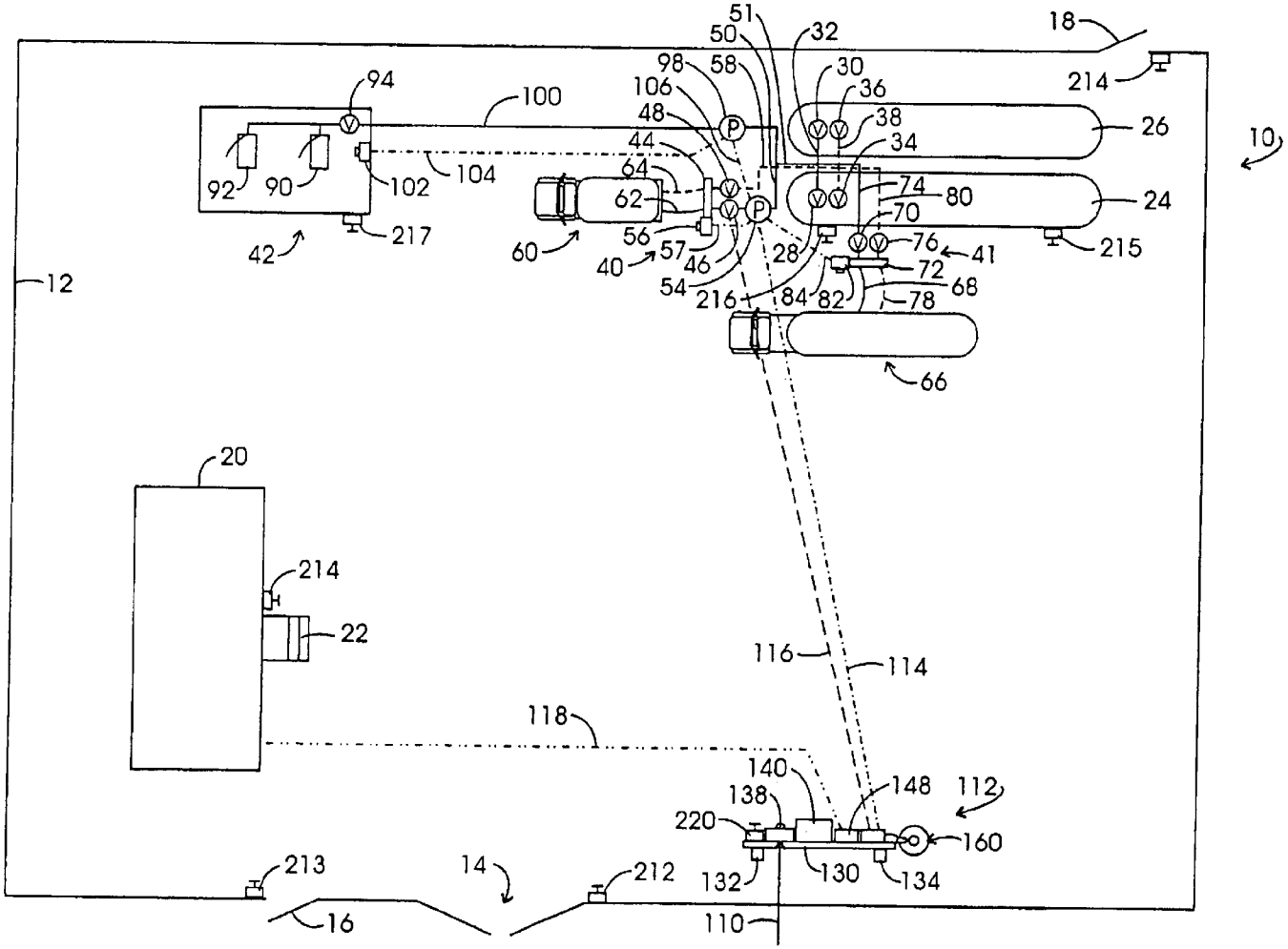
FIG. 1 is an overhead schematic view of a combustible fluid distribution facility.

Referring to FIG. 1, a facility for distributing combustible fluids such as propane is represented in general at 10. Facility 10 is typical, having a perimeter as represented at 12 which is established with a chain link fence. The chain link fence at perimeter 12 is shown as having a vehicle entrance and exit gate represented generally at 14 as well as personnel gates or entrances/exits at 16 and 18. Constructed within the perimeter 12 is an office building 20 having entrance/exit stairs 22. Facility 10 is seen to include two elongate principal storage tanks 24 and 26 which typically will have a capacity of for instance 18,000 gallons or 30,000 gallons. Tanks 24 and 26 incorporate lower disposed or fluid region tank valves respectively represented by the valve symbols 28 and 30. Tank valves 28 and 30, which are sometimes referred to fire valves, have commonly connected outputs as represented by liquid conduit assembly line 32. Tanks 24 and 26 additionally are configured with vapor equalization valve assemblies accessing their upwardly disposed vapor region. Referred to herein as vapor tank valves the assemblies are symbolically shown at tanks 24 and 26 at respective symbols 34 and 36. The outputs of these valves are commonly connected by conduiting as represented by the dashed line 38. Three fluid transfer stations are represented in general at 40–42. Station 40 is schematically portrayed as having a stanchion or buttress 44 at which conduit connections are supported. In this regard, a pneumatically enabled fluid fill or emergency shut-off valve is represented at symbol 46, while a corresponding pneumatically enabled vapor emergency shut-off valve is represented at symbol 48. Valves 46 and 48 are normally spring biased to close and are manually actuable to an open orientation. They will remain in that open orientation only under the application of a pneumatic bias to them. Fill valve 46 is associated with a fluid conduit assembly represented by lines 50 and 51, the latter solid line extending to solid line 32 representing the fluid source from tanks 24 and 26. Note that line 50 incorporates a fluid pump represented by the symbol 54. Pump 54 is electrically driven, and is operated upon its motor being electrically enabled. Following such enablement the pump is turned on by operator actuation of a pump switch as represented at 56 in conjunction with dashed line 57. Vapor shut-off valve 48 communicates with the common vapor conduit assembly shown as dashed line 38 as is represented by dashed line 58. A truck or vehicle with a frame-mounted distribution tank is represented generally at 60 parked in adjacency with stanchion 44 at station 40. Such vehicles as at 60 serve to distribute the combustible fluid such as propane to customers within a somewhat local region, for example, within a radius of about 40 miles from facility 10. Commonly referred to as a "bobtail", vehicle 60 is shown having a fluid input coupled with fluid fill or shut-off valve 46 as represented at solid line 62 and a connection with the vapor equalization conduit assembly including vapor shut-off valve 48 as represented by dashed line 64.

Station 41 is located to additionally provide for the offloading of propane into the tanks 24 and 26 from the supply tank of a larger delivery vehicle represented generally at 66. Typically referred to as a "transporter", the vehicle 66 generally will have on-board pumping capabilities. Accordingly, to deliver propane to tanks 24 and 26, a conduit assembly represented by solid line 68 extends from vehicle 66 to connection with another pneumatically enabled but hand actuated fluid fill or shut-off valve represented at symbol 70 located in adjacency with stanchion or buttress 72. Fill or shut-off valve 70 is coupled via conduit assembly 74 to the propane outputs of tank valves 28 and 30 as represented at solid line 32. The vent valve of the supply tank of vehicle 66 is coupled in fluid communication with a vapor shut-off valve represented at symbol 76 by a vehicle-contained conduit assembly represented at dashed line 78. Vent shutoff valve 76 is shown associated with the tank venting valves 34 and 36 by dashed line 80 extending to dashed line 38. In general, fluid is pumped from the vehicle 66 via conduit 68 and through valves 28 and 30 into the respective tanks 24 and 26. Where the station 41 is employed for off loading to vehicles as at 60, pump 54, following its electrical motor drive enablement, is activated by the operator by the actuation of a stanchion mounted switch 82, the association switch 82 with pump 54 being represented by dashed line 84.

Station 42 is intended for carrying out the filling of distribution tanks implemented as small cylinders, the filling of such cylinders being monitored with weight scales. Accordingly, such stations as at 42 often will have a roof covering or will be provided within a building. For the instant demonstration, the station 42 is shown having two scale-containing filling positions shown at 96 and 92. These positions will be associated with a fill or shut-off valve as represented at the symbol 94, the valve 94 being associated with the output of an electric motor driven fluid pump represented at symbol 98 and a fluid conduit assembly represented by solid line 100. Line 100 is seen to incorporate pump 98 and extend to solid line 50, in turn extending solid line 51 to symbolic line 32. Upon its motor drive being electrically enabled, pump 98 is activated from a pump switch 102 as represented at dashed lines 104 and 106. Note that line 106 extends additionally to pump 54. In general, for small cylinders as would be filled at fill station 42, no vapor equalization venting back to tanks 24 and 26 is utilized.

Electric line power is shown being introduced to the facility 10 as represented at arrow 110. This input which, for example may be a 220 volt line, is introduced to a utility and control station represented generally at 112. An electric power input to the pumps 54 and 98 is represented by dashed and dotted line 114 extending from the utility and control station 112. Similarly, a pneumatic actuation and enabling conduit assembly is represented generally as extending from the utility and control station 112 as represented by dashed line 116. This pneumatic input extends in common to all of the above-discussed valves, i.e., valves 28, 30, 34, 36, 46, 48, 70, 76, and 94. An electric utility input to the building 20 is represented at dashed and dotted line 118.

Figure 2:
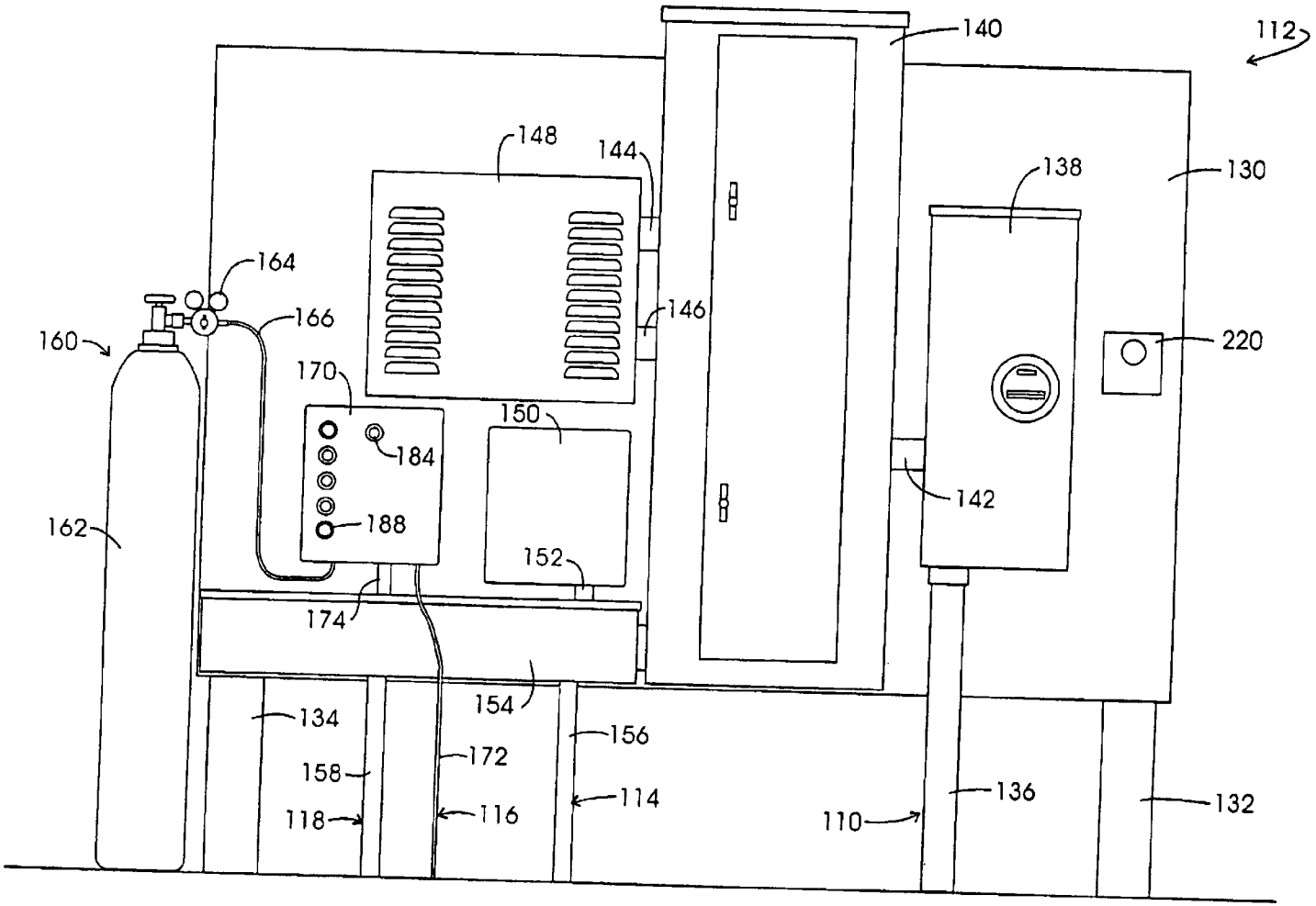
FIG. 2 is a plan view of a utility and control station employed with the facility shown in FIG. 1.

Looking additionally to FIG. 2, the utility and control station 112 is seen to be mounted upon a conventional utility board 130 supported upon posts 132 and 134. A 220 volt power input as represented at arrow 110 in FIG. 1 is represented in general in FIG. 2 by that same numeration as extending through a protective electrical conduit 136 which extends, in turn, to an industrial meter box 138. Of course, other line voltages may be employed. The output from box 138 extends to a circuit breaker box 140 as represented at an electrical conduit 142. From circuit breaker box 140, as represented at protective conduits 144 and 146, electrical output extends to a three phase conversion box represented at 148. This three phase conversion function is required for providing three phase electrical input to motor starters retained with a circuit box 150. Inputs and outputs to box 150 are represented as extending within a protective conduit 152 to an electrical distribution trough or box 154. From box 154, the pump power enablement input described in conjunction with dashed and dotted line 114 in FIG. 1 is again represented in general with that numeration at a protective electrical conduit 56. FIG. 2 also shows the distribution of electrical power to the building 20 again represented in general at 118 in FIG. 2 but in conjunction with a protective electrical conduit 158 extending from the distribution trough 154.

A source of gas under pressure is represented generally at 160 and is seen to be implemented as shown in FIG. 2 as a cylinder 162 containing nitrogen gas. The output of the cylinder 162 is coupled with a regulator 164, the output of which, in turn, is connected by a conduit 166 to a principal housing 170 incorporating features of the control system of the invention. Seen extending from housing 170 is a portion 172 of a gas conduit assembly described in conjunction, for example, with dashed line 116 in FIG. 1. That general numerical identification again is reproduced in FIG. 2. Electrical input from the housing 170 to the distribution box or trough 154 is represented at protective conduit 174.

Figure 3:
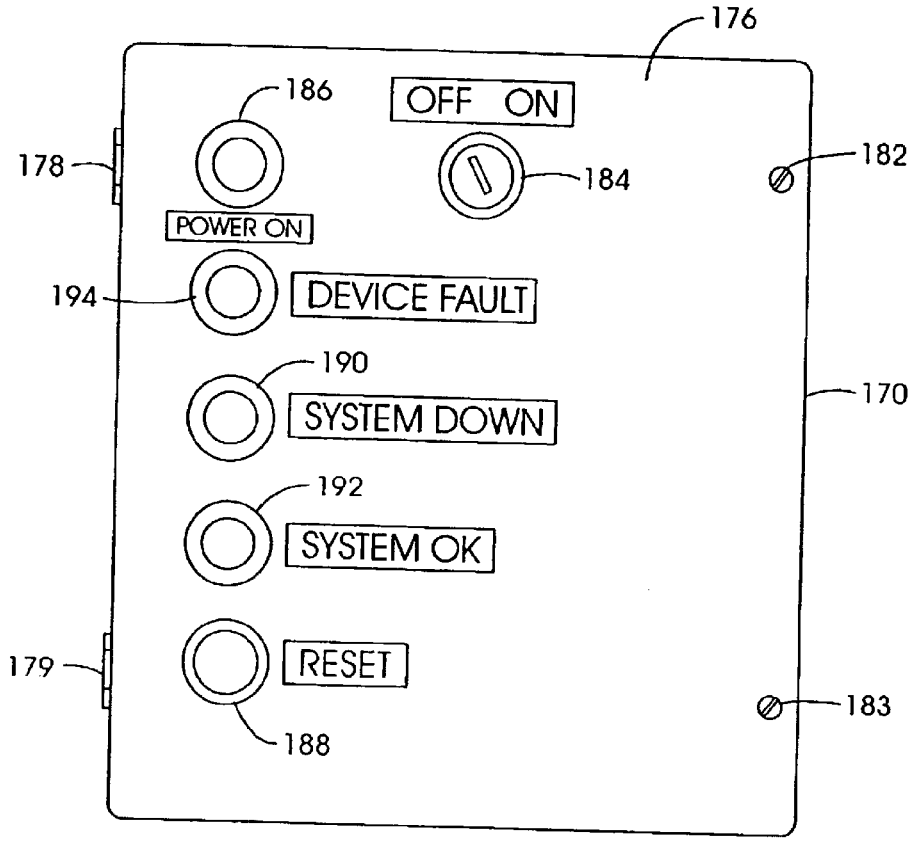
FIG. 3 is a front view of a housing employed with the control system of the invention.

Looking additionally to FIG. 3, the principal housing or console 170 is reproduced with a larger scale, the housing 170 is configured with a front cover 176 which may be opened about hinges 178 and 179 and which is retained closed by machine screws 182 and 183. In general, the housing 170 is formed of a material such as fiber reinforced plastic which permits the reception and/or transmission of RF signals or the like. Shown mounted upon the cover 176 is a power switch 184 which is key actuated by an operator. This key actuation feature will be seen to provide facility management with an option of providing the key which turns this switch on or off in conjunction with the ignition key of a distribution truck or the like. Both the vehicle key and the system key as is used with switch 184 are coupled to a secure key retainer. This is an arrangement which requires that both keys remain together all of the time. Switch 184 provides power input to the entire system through the control arrangement contained within housing 170. When switch 184 is turned to the off position, then all power and enablement is dropped from the distribution pumps of the facility 10. Turning switch 184 to the on position will cause the illumination of a visual cue at cuing device 186. Once the switch 184 is actuated to the on position, the operator actuates and holds on a push-type start or reset switch 188 for an interval adequate to provide pneumatic enablement of the above-discussed valves from the source of gas under pressure 160 and conduit assembly 116 (FIG. 2). During the interval of pressure build-up in the conduit assembly 116, a system down visual cue as seen at 190 will be illuminated. With the development of appropriate pressure within the conduit assembly 116, a system ok visual cue 192 will be illuminated and the system down cue will be deactivated. The operator then may release the start or reset switch 188. The third visual cue mounted at cover 176 is a device fault cue 194. This cue is illuminated when one of the emergency system shut-down transmitters employed with the instant invention is defective.

Figure 4:
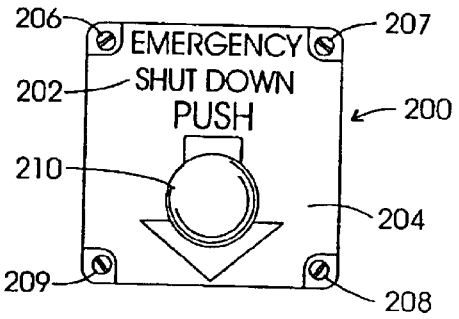
FIG. 4 is a front view of an emergency shut-down transmitter employed with the system of the invention.

The system and method of the invention performs in conjunction with a wireless receiver incorporated within the housing 170 and one or more transmitters strategically positioned about the facility 10. Looking to FIGS. 4 and 5, two such transmitters are revealed. In FIG. 4, a transmitter 200 is seen to comprise a weather-proof and transmission accommodating housing 202 having a front cover 204 retained in position by machine screws 206-209. Located upon and extending through the cover 202 is a momentary on push button switch 210 located in conjunction with an emergency shut-down "push" message. When the switch 210 is actuated by an operator, electrical power to all pumps is removed and pneumatic enablement or actuation of the above-noted valves is removed additionally by venting the conduit assembly 116. When any operating personnel within facility 10 perceives an emergency condition associated with the tanks 24 and 26 such as the commencement of a flame or the like, they are instructed to abruptly leave the facility 10. As they leave, the emergency shut-down devices as at 200 will be located along their emergency exit path. Returning to FIG. 1, note that one such transmitter 212 is located adjacent vehicle gate 14 and another such transmitter 213 is located adjacent gate 16. Similarly, a transmitter 214 is located adjacent personnel gate. 18. In the vicinity of tanks 24 and 26, transmitters as at 215 and 216 are provided. Additionally, such a transmitter is located on the outside of the building facility 42 as shown at 217. Another transmitter 218 is located at building 20 adjacent the entrance/exit steps 22 as shown at 219 and still another such transmitter 220 is located at utility board 130. In general, the transmitters 212–220 perform at 900 MHz frequencies. To reduce the impact of in-band interference, the devices perform in conjunction with a frequency hopping, spread spectrum technology as opposed to transmitting on a single frequency. In this regard, the devices send redundant signals across a 10 MHz band. Of importance, the transmitters can send check-in signals as often as every ten seconds, allowing the detection of a missing or malfunctioning transmitter in less than one hour. In the latter regard about 15 minutes is used. In this regard, the receiver function within principal housing 170 functions to poll within selected windows of time the coded transmitter check-in signals. Upon detection of a defective transmitter, the above-described device fault visible cue 194 is illuminated. The receiver function provides a readout indicating the individual transmitter or transmitters which are defective. For the instant application, a model FA210M transmitter, marketed by Inovonics Corporation of Bolder Colo. may be employed.

Figure 5:
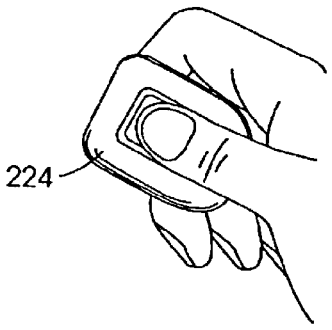
FIG. 5 is a front view of another version of an emergency shut-down transmitter employed with the system of the invention.

Management may also carry a handheld transmitter as shown at 224 in FIG. 5. Once the pump power has been disenabled and the pneumatic enablement has been disenabled by actuation of any of these transmitters, the system can only be recovered by the momentary depression of start or reset switch 188 for an interval adequate to again achieve pneumatic enablement from the conduit assembly 116.

Figure 6:
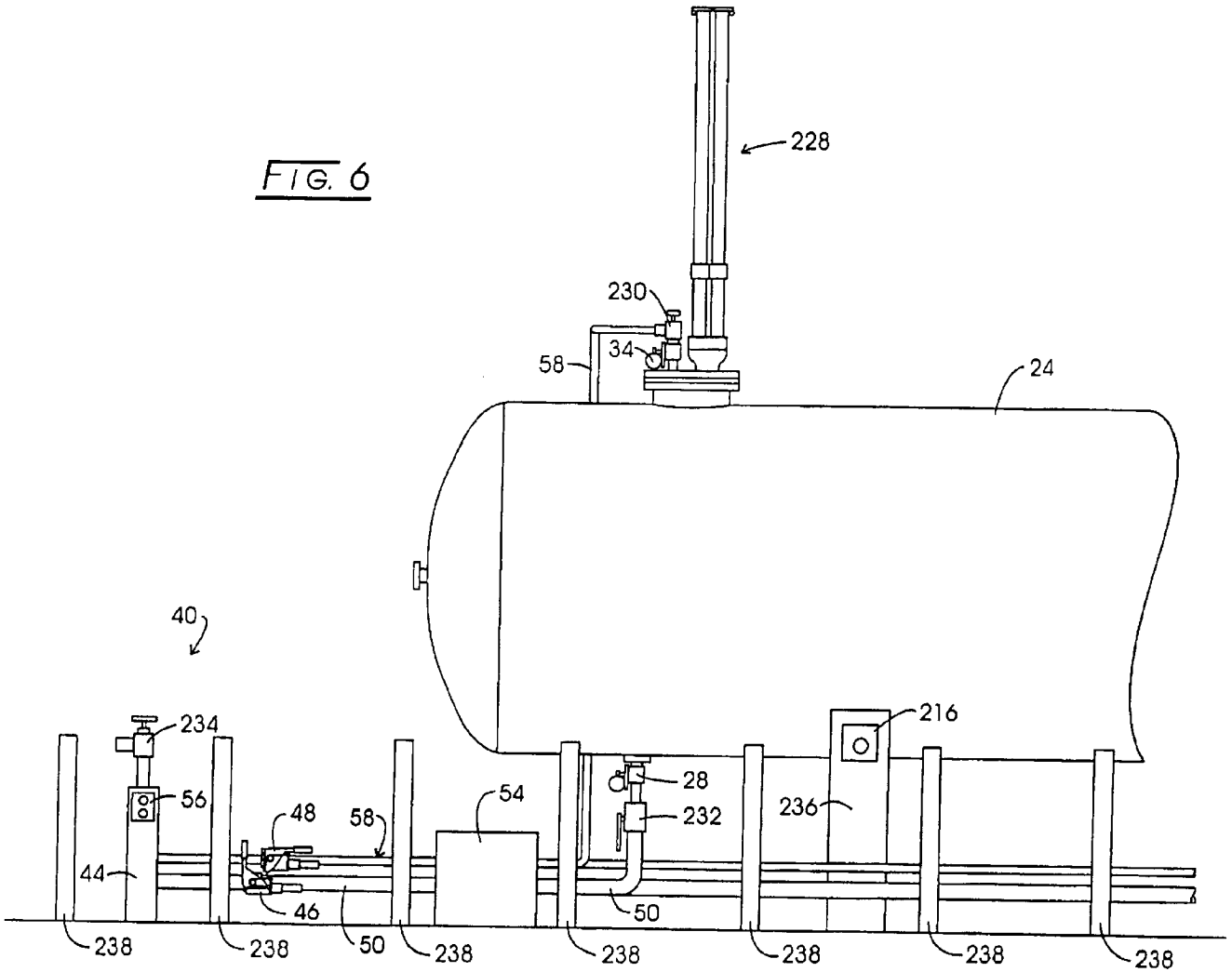
FIG. 6 is a partial view of a principal fluid storage tank and associated fluid transfer station and valving as shown in FIG. 1.

Referring to FIG. 6, a more detailed partial view of the fluid transfer station 40 and its association with tank 24 is provided. In the figure, the vapor region of tank 24 is seen accessed by venting stacks represented generally at 228. The stacks 228 relieve excessive vapor pressure to the atmosphere. The pneumatically actuated vapor tank valve earlier described at 34 reappears in the instant figure with that same identifying numeration in conjunction with a normally open manually actuable auxiliary valve 230. Vent valve 230 is closed, for example, for tank maintenance purposes and the like. Vent conduit 58 is seen extending from valves 34 and 230 to the pneumatically enabled vapor shut-off valve earlier described symbolically at 48 and shown in more detail in the instant figure with the same identifying numeration. Conduit extending from valve 48 is shown, in turn, extending to the stanchion 44 of station 40. The fluid region of tank 24 is accessed by a tank valve described symbolically in FIG. 1 at 28 and shown at a higher level of detail in the instant figure also being identified with the same numeration. Coupled adjacent to the pneumatically actuated valve 28 is a manually actuated isolation valve 232 which is normally open and is closed for purposes of servicing tank 24. Valves 28 and 232 are coupled with fluid conduit assembly 50 extending to pump 54 and thence to a fill or emergency shut-off valve described earlier symbolically at 46 and shown with the same identifying numeration at an enhanced level of detail in the instant figure. The conduit assembly then continues to stanchion 44 of station 40 extending through a manual valve 234 having an outlet configured for coupling to a flexible fluid conduit described at 62 in FIG. 1. Note that the end of tank 24 as illustrated is supported upon a saddle 236. Additionally, it may be noted that the periphery of the tank 24, pump 54 and stanchion 44 is provided with a sequence of projective, spaced-apart upstanding steel posts 238.

Figure 7:
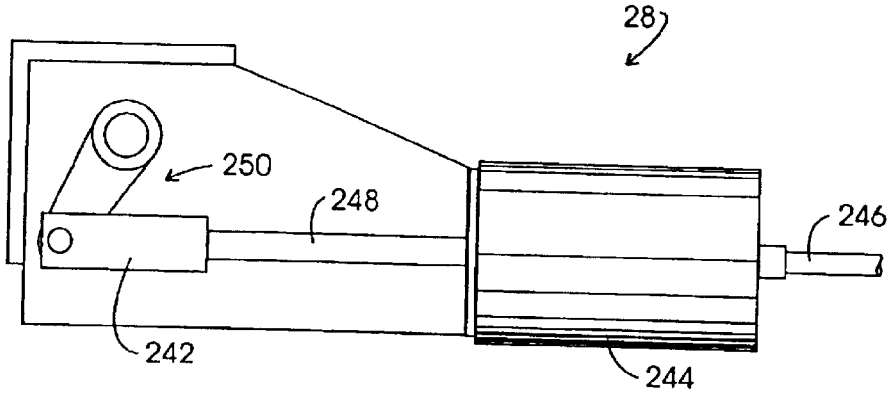
FIG. 7 is a plan view of a tank valve actuator employed with the system shown in FIG. 1.

Referring to FIG. 7, the pneumatic actuator component of valve 28 is revealed at an enhanced level of detail. This actuator as shown at 240 functions to actuate a threaded internal valve, for example, a type C427 marketed by Fisher Controls, Inc. of McKinney, Tex. The actuator 240 includes a steel mounting bracket 242 having a spring return pneumatic cylinder 244 attached to one side thereof. Pneumatic input is provided from the conduit assembly component shown at 246. In this regard, with the application of a gas such as nitrogen gas under pressure at conduit 246, the cylinder rod assembly 248 is driven outwardly to, in turn, actuate a crank assemblage represented generally at 250. Release of pneumatic pressure at conduit 246 will cause the cylinder 244 to withdraw rod 248 and rotate crank assemblage 250 in the opposite direction. Actuators as at 240 may be provided, for example, as a type P326 marketed by Fisher Controls, Inc. (supra).

Figure 8:
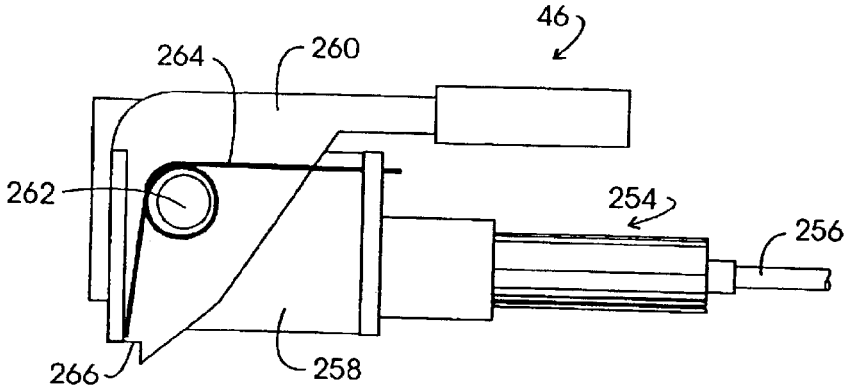
FIG. 8 is a plan view of an emergency shut-off valve employed with the system shown in FIG. 1 and illustrating a closed orientation of its components.

Fill valve 46 and vapor shut-off valve 48 were described symbolically in connection with FIG. 1. These valves are pneumatically enabled and manually actuated to an on-state. Removal of the pneumatic enablement will cause them to return under spring bias to a closed condition. These valves are typically referred to as "emergency shutoff valves" and are marketed, for example, as type N550w/P327D by Fisher Controls, Inc. (supra). Referring to FIG. 8, valve 46 is revealed in its closed orientation at an enhanced level of detail. The valve includes a pneumatic cylinder assembly represented generally at 254 which is coupled to the pneumatic conduit assembly, a portion of which is revealed at 256, as well as being supported from a bracket assembly 258. A manually actuated valve crank and handle is shown at 260 which is pivotally mounted upon bracket 258 at a shaft 262 and is spring biased into the dosed orientation shown by a spring 264. Note the engagement notch 266 within the crank 260 as it is oriented in the closed position. A roller type cam follower may be employed in substitution for notch 266 to facilitate hand actuation of the value.

Figure 9:
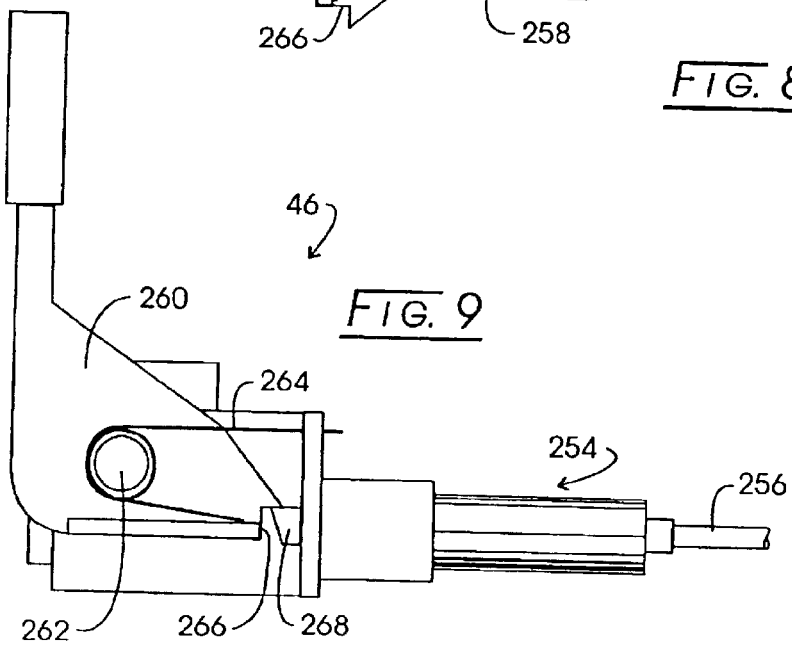
FIG. 9 is a plan view of the valve shown in FIG. 8 illustrating the arrangement of its components in an enabled and actuated orientation.

Referring to FIG. 9, the valve 46 is shown in its pneumatically enabled and manually actuated on-state. With the application of pneumatic pressure to the cylinder assemblage 254, an engagement rod or cam 268 has been outwardly extended from the cylinder 254 and retained in the position shown by pneumatic pressure applied from conduit assembly 256. Note that the cam 268 has engaged the notch 266 in valve crank 260. With the removal of pneumatic pressure from the conduit assembly 256, a spring bias within cylinder 254 will withdraw this cam 268 to release the crank 260 for movement under the bias of spring 264 into the orientation shown in FIG. 8.

Figure 10:
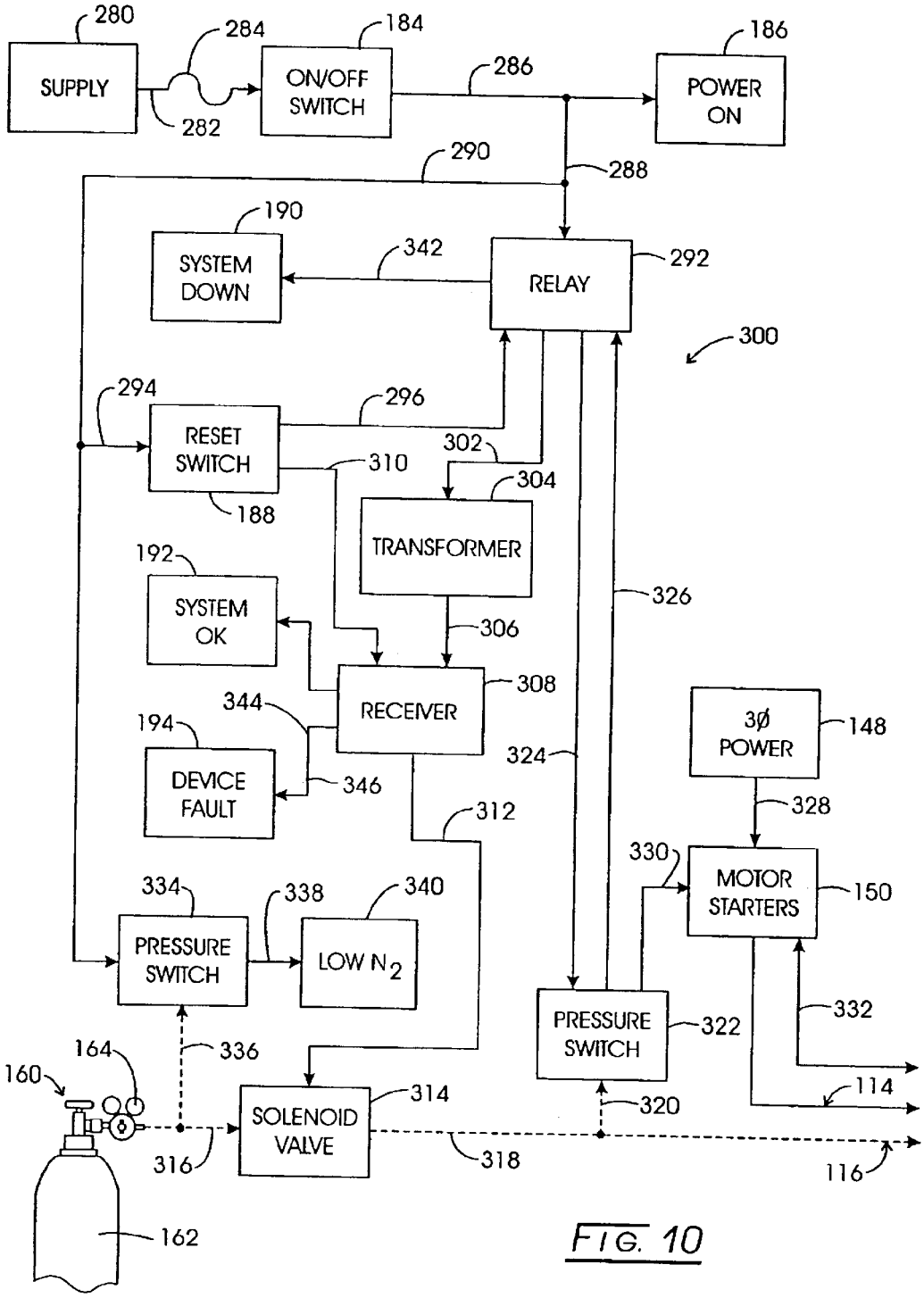
FIG. 10 is a block schematic diagram of the control system employed with the facility shown in FIG. 1.

Referring to FIG. 10, a block diagrammatic representation of the control system of the invention, for example, as located at utility board 130 (FIGS. 1, 2) is provided. In the figure, electrical power input, for example, at 120 volts a.c. is represented at supply block 280 and line 282. Line 282 incorporates a fuse 284 and is seen directed to the on/off switch function earlier described at 184 (FIG. 3) and identified with same numeration in the instant figure. Actuation of this power switch 184 to an on condition, causes the power output thereof at line 286 transition from an off condition to provide a power output. Line 286 is seen to extend to a power on cuing device as earlier described at 186. This cuing device is implemented generally as a lamp or light emitting diode (LED) and is represented in block form with the same numeration in the instant figure. The power output at line 286, as represented at lines 288 and 290 is introduced to a relay as represented at block 292 to effect its enablement and, as represented at lines 290 and 294 to the input of momentary on, reset switch 188 here represented in block form. In starting the system up, after actuating the switch 184 to an on condition, the operator depresses the start or reset switch as represented at block 188 and holds it in an on condition. The start switch 188 is operationally associated with relay 292 as represented at line 296. This causes the relay to close at least during the interval of actuation of switch 188. Relay 292 is a component of a control network represented generally at 300 which, additionally, as represented at line 302 and block 304 supplies a power input to the primary side of a step down transformer 304. Control network power, for example at about 12 volts, then is applied as represented at line 306 from the secondary side of transformer 304 to a receiver circuit represented at block 308. Circuit 308 may be provided, for example, as a type FA575 receiver and control system marketed by Inovonics Corporation (supra). Circuit 308 is activated in the presence of the system start output developed with reset or start switch 188 as represented at line 310. Upon such activation, receiver 308 applies an on-state input as represented at line 312 to an electrically controllable valve represented at block 314. Sometimes referred to as a "solenoid valve", the valve 314 may be of a two position, four-way variety marketed by Ingersoll-Rand Company of Bryan, Ohio. The input to valve 314 is coupled with the source of gas under pressure or nitrogen supply 160 as represented at dashed line 316. One output of the valve 314 is coupled with the conduit assembly earlier described in general at 116 and herein initially represented at dashed line 318. The earlier general numeric designation 116 reappears in FIG. 10. At the commencement of control, as long as the start or reset switch 188 is held on by the operator, solenoid valve 314 continues to apply nitrogen gas under pressure from source 160 to the system extending to the earlier described tank and fill or shut-off valves. The level of nitrogen or gas pressure within the line 318 is monitored by a gas pressure control monitor or pressure switch as is represented at dashed line 320 and block 322. Pressure switch 322 may be provided, for example, as a type SW 134 pressure electric switch marketed by CAPP/USA, of Clifton Heights, Pa. The switch 322 is initially powered or enabled from relay 292 upon the actuation of start switch 188 as represented at line 324. When the pressure at pneumatic lines 318 and 320 reaches an enable value or threshold value, then the switch 322 assumes a system enable condition serving to latch relay 292 into an on condition as represented at line 326. At this point in time in the start up procedure, the operator may release start or reset switch 188 and the system will continue to control. The three phase power output earlier-described at 148 in connection with FIG. 2 as well as the motor starter function described at 150 in connection with that figure reappear with the same numeration in block form in the instant figure, three phase power from block 148 being introduced to motor starter function 150 as represented at line 328. Motor starters 150 are enabled in the presence of the system enable condition at pressure switch 322 as represented at line 330. The motor starter output again is represented at line 114 and the input to the motor starters effecting the start-up of the pump motors from the hand actuated switches described, for example, at 56, 82 and 102 in FIG. 1 is represented at line 332.

Line 290 additionally is seen to be directed to a second pressure switch represented at block 334. Pressure switch 334, as represented at dashed line 336 functions as a source pressure monitor which is responsive to the pressure of gas at the source of gas 160. Where that pressure is low, for example, due to depletion of the gas supply in cylinder 162, then a fault condition is generated as represented at line 338. This fault condition functions to activate a cuing device indicating, for example, low nitrogen pressure as represented at block 340.

Looking again to the cuing devices, in addition to the power on cue provided as shown at block 186, at such time as power is applied to relay 292, as represented at line 342, the system down cuing device is activated. That device is shown in FIG. 2 in conjunction with the visual cue 190 which numerical designation is utilized in conjunction with the instant figure. Upon activation of the relay 292, for example, by initially depressing the start or reset switch 188, the system ok cuing device earlier described at lamp 192 is illuminated and the system down cuing device 190 is deactivated. The system ok device, described in conjunction with FIG. 2 as a lamp or LED is activated from the receiver circuit 308 as represented at line 344. Receiver 308 performs a periodic monitoring of the status transmissions from transmitters 212-220. This monitoring occurs during operator elected windows or intervals, for example, every ten minutes. In the event that a coded transmission is not received from one of the transmitters within a given window, then the receiver 308 will provide an indication of which transmitter is in default and provide a perceptible cue identifying that a device fault is at hand. The cuing device is described in connection with FIG. 2 as a lamp or LED. That function is repeated in the instant figure as block 194, its association with the receiver circuit 308 being represented at line 346. Cuing devices 186, 190, 192, 194 and 340 may take a variety of configurations. In their simplest manifestation, they are provided as lamps or LEDs. However, they can be employed to broadcast such information to a remote monitoring station or the like and can provide an acoustic output as well as a visual output.

Figure 11:
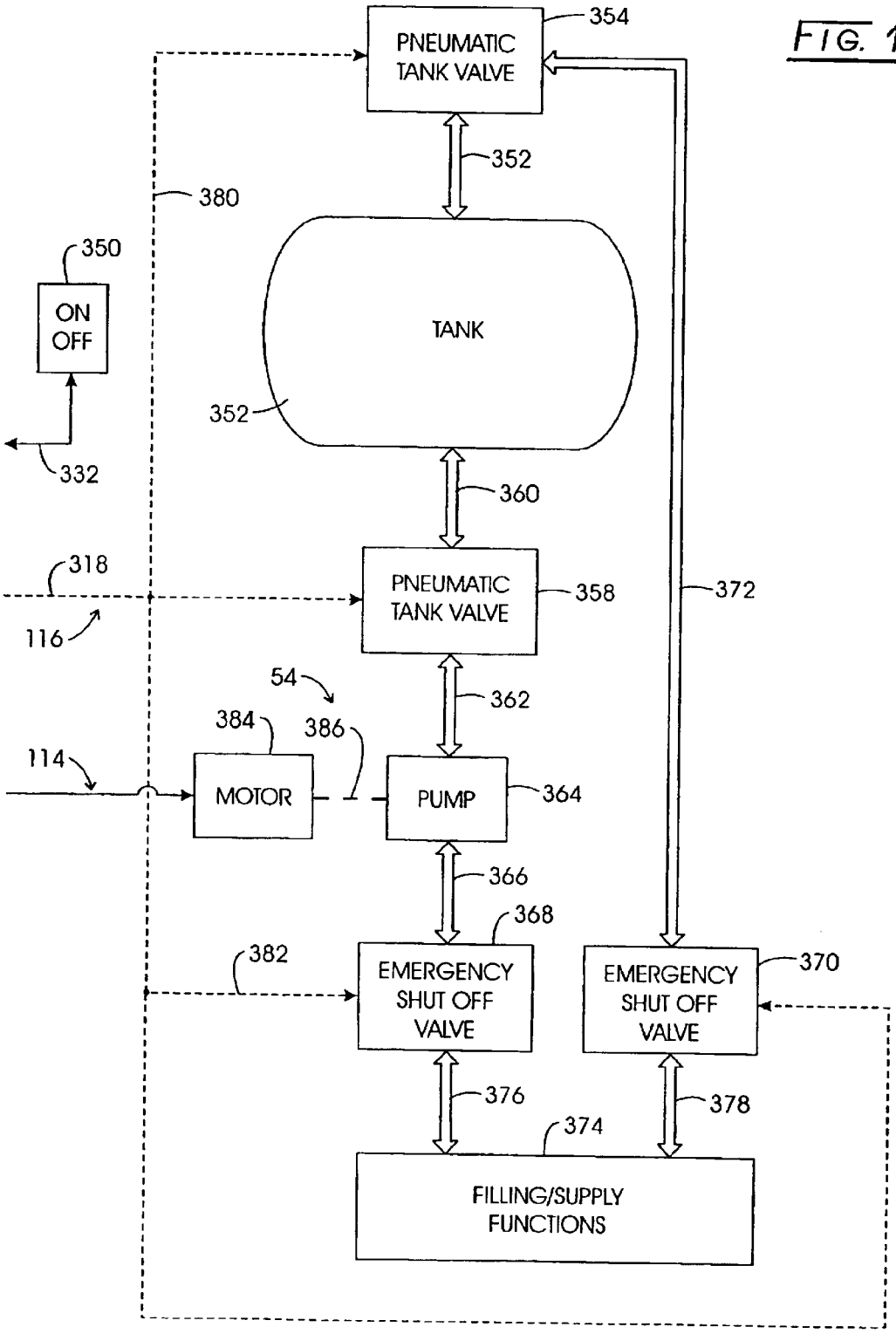
FIG. 11 is a block schematic diagram of the storage tank and associated valving function shown in FIG. 1.

Referring to FIG. 11, a schematic representation of the control input and activities in the vicinity of the principal fluid storage tanks is provided. It may be seen that the pneumatic conduit assembly 116 as represented in FIG. 10 at 318 reappears. Additionally, an electric pump starting switch is seen coupled to earlier described line 332 which also reappears and that switching function is represented at block 350. Motor enablement line 114 extending from the motor starter function 150 reappears with that former numeration. In the figure, the principal fluid storage tank function is represented at symbol 352. The pneumatic vapor shut-off valve function is represented at block 354 and arrow 356 extending to the tank symbol 352. Correspondingly, the liquid region of the tank function 352 is associated with a pneumatically actuated tank valve function as represented at block 358 and arrow 360. Fluid output from the valve function represented at block 358, is directed as represented at arrow 362 and block 364 to the input of the pumping function. Fluid pump output from the pumping function 364 is shown, as represented at arrow 366 and block 368 as being directed to a pneumatically enabled and hand actuated fill valve or emergency shut off valve located at a fluid transfer station. Correspondingly, the pneumatically enabled but manually actuated vapor shut-off valve function at the fluid transfer station is represented at block 370. The pressure association between the shut-off valve function 370 and vapor tank valve function 354 is represented at arrow 372.

The filling and supply functions associated with tank function 352 are represented in general at block 374. Those filling/supply functions are associated with the fill valve functions of block 368 as represented at dual arrow 376 and with the vapor communication valve 370 at dual arrow 378.

With the initial depression of start or reset switch 188 (FIG. 10) solenoid valve 314 communicates the source of gas under pressure 160 with conduit assembly line 318. Line 318 in FIG. 11 is seen to extend to the pneumatic tank valve function 358 and via dashed line 380 to the actuating function of the vapor tank valve function 354. Line 380 additionally is seen to extend to enable the vapor shut-off valve function 370 and additionally via dashed line 382 to the fill valve function represented at block 368. At such time as the gas pressure control monitor function 322 assumes a system enable condition, the valve functions 354 and 358 will have been actuated to an open state and the valve functions represented at blocks 368 and 370 will have been enabled pneumatically. Additionally, the motor starter function 150 will have been enabled such that the pump motor function now represented at block 384 and dashed line 386 will be enabled such that motor 384 will be actuated to a driving state with respect to pump function 364 upon operator actuation of the fluid transfer station located switching function 350.

With the arrangement shown, an operator carrying out the filling of a distribution tank actuates the power on switch 186, for example, with a key and pushes the start or reset switch 188 for an interval long enough for pressure switch 322 to gain a system enable condition. The operator then proceeds to a fluid transfer station, connects the appropriate flexible conduits, and manually actuates the now enabled valve functions 368 and 370. Then, the pump switching function 350 is actuated to carry out a filling procedure.

Essentially the same procedure is carried out when a transporter vehicle with associated supply tank provides supply fluid to the principal tank function 352. In this regard a vehicle mounted pumping function is utilized. For either procedure, at the termination of the distribution tank filling or principal storage tank supply, where appropriate, the switching function 350 is actuated to an off condition to stop motor function 384 and the valve functions 368 and 370 are manually actuated to a dosed condition. Upon disconnecting the fill or supply conduits, the operator then proceeds to the housing 170 and actuates power switch 184 to an off condition. The system then removes power from relay 292 which causes solenoid valve 314 to be spring actuated to an off-state venting conduit assembly line 318 and blocking input line 316. Pressure switch 322 then assumes an off condition disabling the motor starter function 150. The venting of line 318, in turn, disenables the valve functions 354, 358, 368, and 370. Accordingly, the entire system is shut down with the actuation of a single switch.

If during the process of filling a distribution tank or the supply of fluid to the tank function 352, the operator perceives an emergency condition, for example, a flame or the like, he or she is directed to immediately evacuate from the facility 10. Upon exiting, for example, from the exits 14, 16 or 18, the operator will momentarily push any of the button-type switches of the transmitters located at those exits or adjacent wherever the operator may be. That causes a coded transmission to the receiver 308 which, in turn, reacts to turn off valve function 314 to cause the venting of conduit assembly 318 which, in turn, effects the closure of valve functions 354, 358, 368 and 370. Inasmuch as pressure switch 322 then assumes an off condition, the motor starter function 150 is disabled.

Figure 12:
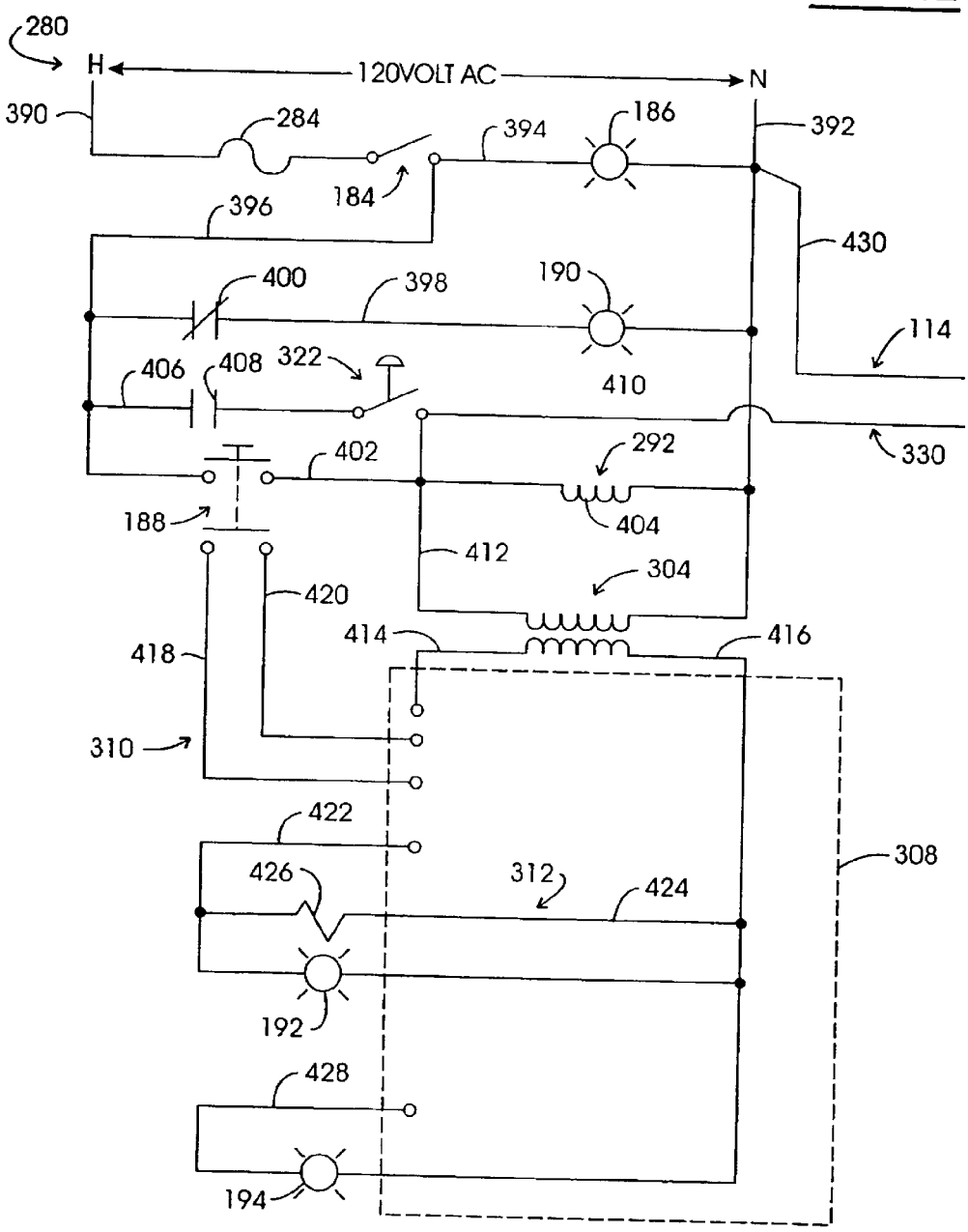
FIG. 12 is an electrical schematic diagram of one embodiment of a control circuit employed with the system of the invention.

Referring to FIG. 12, an electrical schematic representation of one embodiment of the control arrangement of FIG. 10 is revealed. For this embodiment, the receiver function 308 is de-energized when the system is off. Where appropriate, the numerical identification of the functions described in conjunction with FIG. 10 are repeated in this FIG. 12. In the figure, a 120 volt a.c. supply earlier represented at block 280 is shown introduced to the circuit via lines 390 and 392. Line 390 incorporates the fuse function 284 and start or on/off switch 184. Switch 184 is seen to communicate with line 394 incorporating the power on lamp 186 and extending to line 392. When switch 184 is closed, power is supplied to lamp 186, as well as to line 396. Line 396 is seen coupled with line 398. Line 398 incorporates the normally closed contacts of relay function 292 as well as the system down indicator lamp earlier described at 190. Accordingly, the lamp 190 is illuminated. One 396 additionally is seen to extend to start or reset switch 188. When switch 188 is closed, line 396 is coupled with line 402 which incorporates the inductor 404 of the relay function 292 and extends to the line 392 to thus provide for the energization of the inductor 404 and the resultant opening of normally closed relay contact 400, thus turning off lamp 190. Line 396 additionally is seen to be coupled with line 406 incorporating normally open contacts 408 of the relay 292 as well as the gas pressure control monitor or pressure switch 322. Switch 322 is seen to provide, when closed, for the coupling of line 406 with line 410. Accordingly, the energization of inductor 404 additionally closes normally open contacts 408 to enable the pressure switching function 322 which serves to effect the noted system enable condition electrically coupling line 406 with line 410. Line 402 also extends to line 412 which incorporates the primary side of the step down transformer function 304 and extends to line 392. Accordingly, step down voltage levels are supplied to the receiver function represented within dashed boundary 308 from the secondary side of transformer 304 as represented at lines 414 and 416. Closure of start switch 188 also activates this receiver function 308 by electrically coupling lines 418 and 420. The receiver 308 responds by activating lines 422 and 424 to effect the energization of the inductive winding 426 of the electrically controllable valve or solenoid valve 314. It may be noted that lines 422 and 424 are coupled with line 416 and line 422 also incorporates the system ok lamp function 192 to cause its illumination. Where the poling of the status code transmissions from transmitters 212–220 indicates that a transmitter is malfunctioning or down, then line 428 is activated by the receiver function 308 to cause the illumination of device fault indicator lamp 194. With the eventual closure of the switching component of the gas pressure control monitor 322, line 410 is energized and functions to enable the motor starter function 150 from lines 410 and 430.

Figure 13:
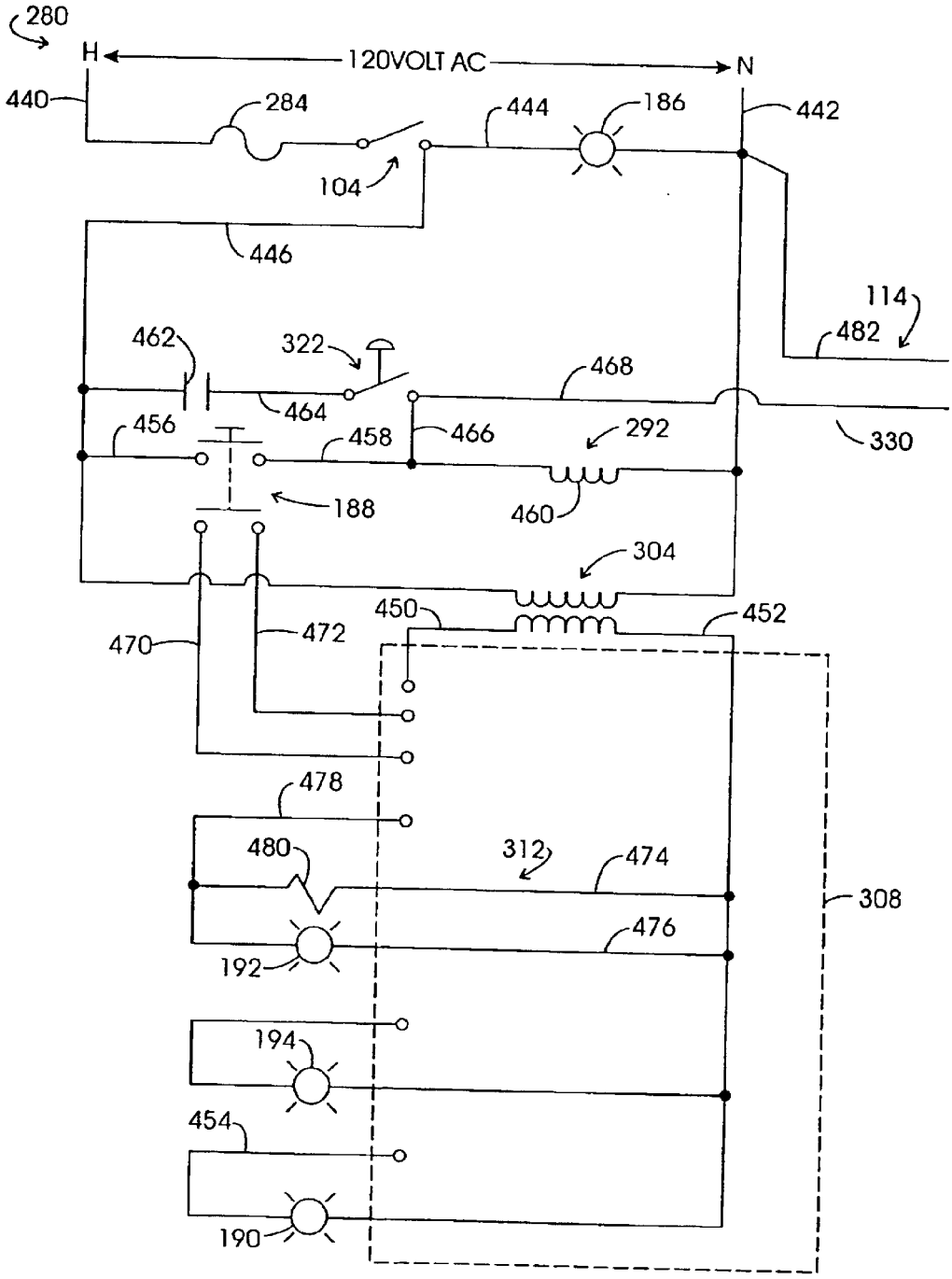
FIG. 13 is an electrical schematic diagram of another version of a circuit employed with the system of the invention.

Referring to FIG. 13, a version of the control circuit wherein the receiver function 308 remains on or enabled following the receipt of an emergency transmission from one or more of the transmitters 212–220 is illuminated. As before, the functions represented in block form in FIG. 10 are generally identified with the same numeration in this figure. In the figure, the 120 volt a.c. power supply earlier-identified at block 280 is shown introduced to the circuit at lines 440 and 442. Line 440 incorporates the fuse 284 as well as on/off or power switch 184. Upon closure of switch 184, line 440 electrically communicates with line 442 via line 444. Line 444 incorporates the power on lamp 186 and thus that lamp is illuminated with the closure switch 184. Line 444 additionally is coupled with line 446 which extends to the primary side of transformer 304. The secondary side of transformer 304 is coupled via lines 450 and 452 into the receiver function 308. Receiver circuit 308 then illuminates the system down indicator lamp 190 by activating line 454. When the operator actuates and holds closed start or reset switch 188, line 456, extending from line 446 is electrically coupled with line 458 incorporating the inductive winding 460 of relay 292. Thus energized, the winding 460 causes the closure of normally open relay contact 462 within line 464 to thus enable the gas pressure control monitor 322 switching function. That switching function is coupled with line 458 via line 466 and to motor enable line 468. Accordingly, the closure of the pressure activated switch 322 will latch inductive winding 460 for continuous closure of normally open contacts 462. The closure of start switch 188 also is recognized by the receiver circuit 308 in consequence of the coupling of lines 470 and 472 from switch 188. This input causes the circuit 308 to de-energize system down lamp or LED 190 and energize lines 474 and 476 from line 478. The energization of line 476 causes the illumination or energization of system ok lamp or LED 192 as well as the energization of the inductive winding 480 of the electrically controllable or solenoid valve function 314. Closure of the switching function of pressure control monitor 322 provides for the activation of both line 468 and line 482 to provide for the enablement of the pump motor function. As is apparent, only the opening of start or reset switch 184 will de-energize the receiver function 308.

Figure 14:
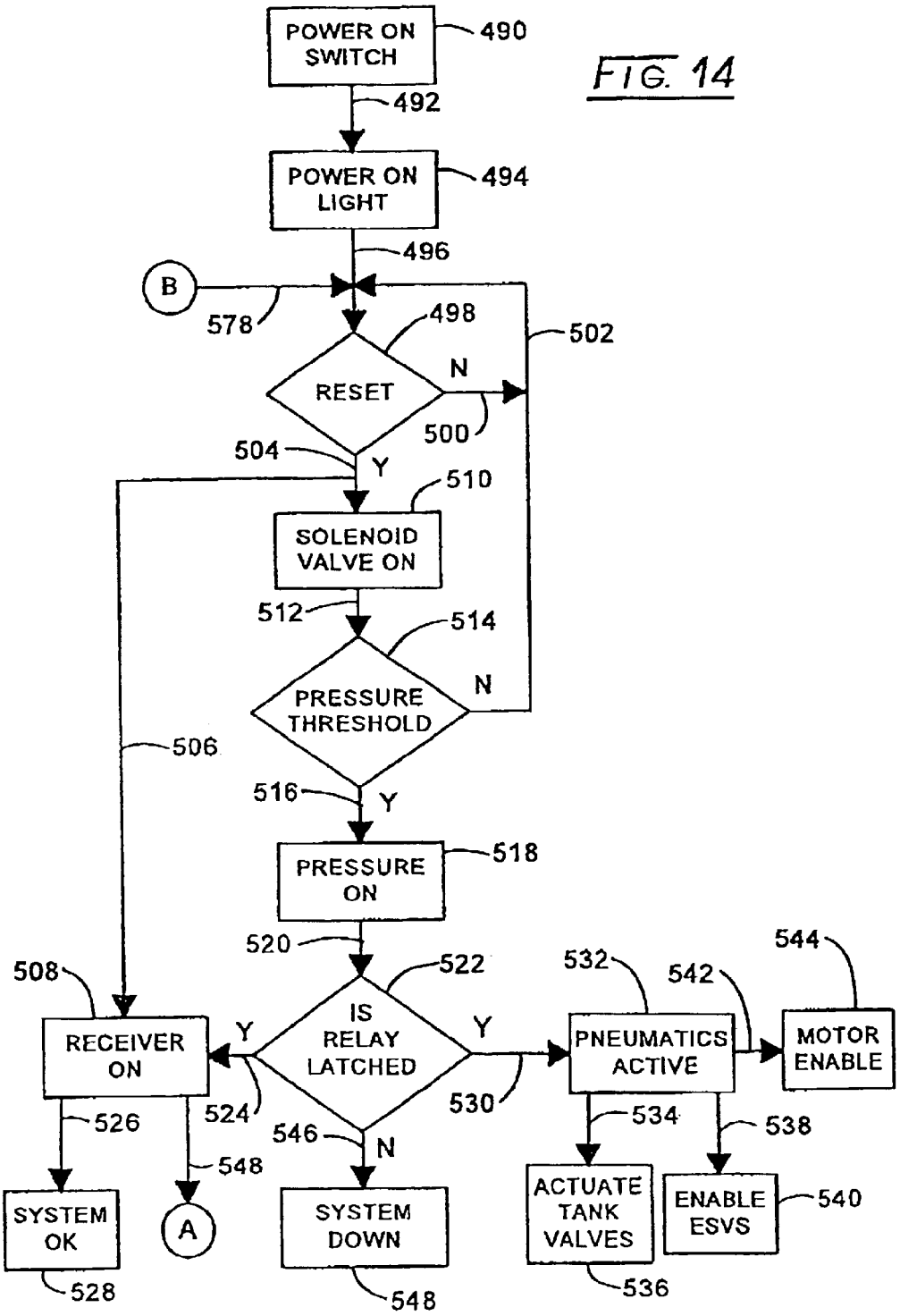
FIG. 14 is a flow chart illustrating the method employed with the invention.
Figure 15:
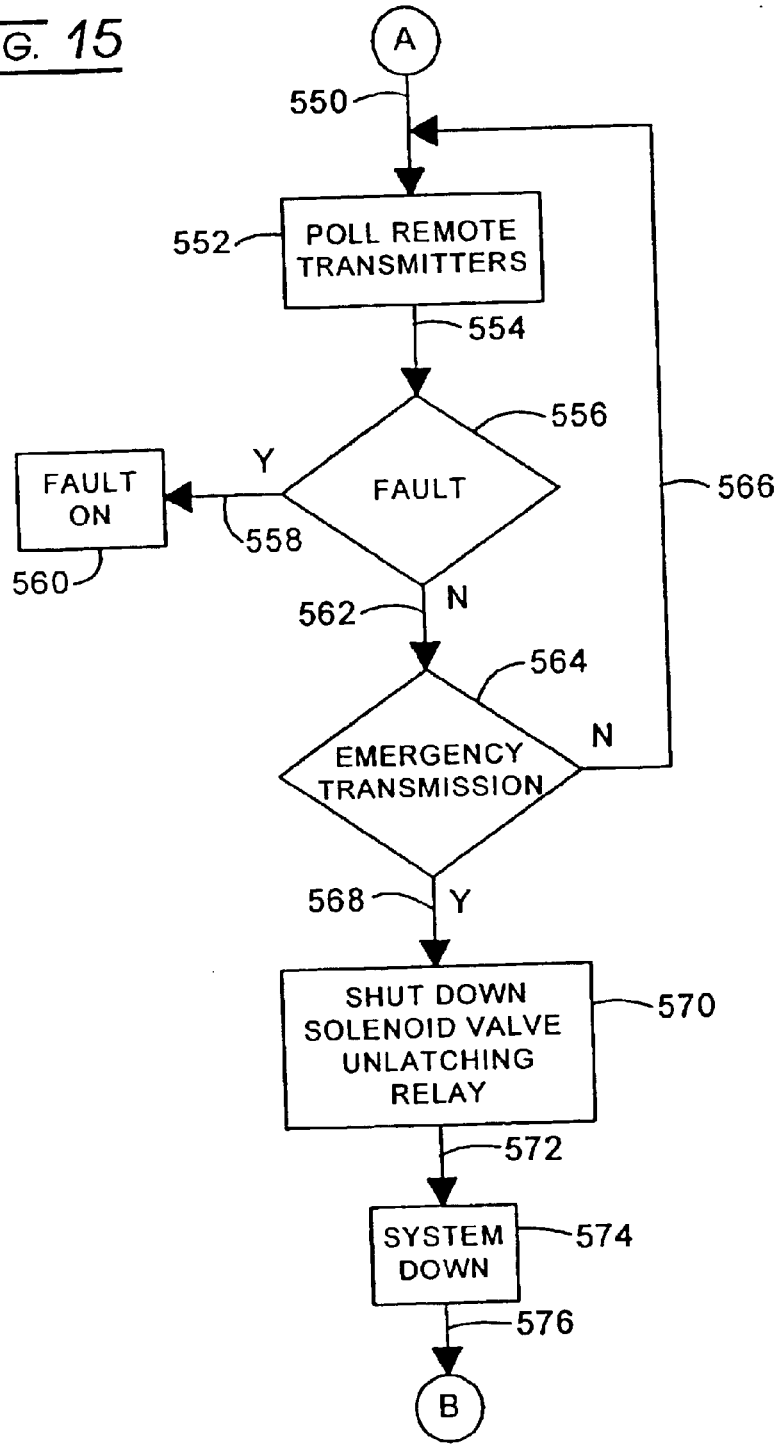
FIG. 15 is a flow chart showing the method of poling remote transmitters and carrying out response to emergency off state signals.

Referring to FIGS. 14 and 15, a flow chart representation of the operation of the control system is set forth. Looking to FIG. 14, the control commences with operator actuation of the power on/off switch as represented at block 490. Then, as represented at arrow 492 and block 494, the power on light 186 is illuminated. As represented at arrow 496, block 498 and arrows 500 and 502. The system then dwells until such time as the operator actuates and holds on start or reset switch 188. With the actuation of the start switch function 188, then as represented at arrows 504, 506 and block 508 the receiver circuit 308 is energized in consequence of the actuation of start or reset switch 188. Additionally, as represented at arrow 504 and block 510, the electrically controllable valve or solenoid valve function 314 is turned on to commence the pressurization of the pneumatic conduit assembly. As represented at arrow 512, block 514 and arrow 502, the system dwells in this condition until the gas pressure control monitor or pressure switch 322 transitions from an off condition to a system enable condition. When the latter condition is reached, then as represented at arrow 516 and block 518 the system enable condition is present with nitrogen pressure at the output of the electrically controllable valve function 314 reaching an enable value. Then, as represented at arrow 520 and block 522 a determination is made as to whether the relay function 292 is latched. As represented at arrow 524 and block 508, this assures that the receiver function 308 remains energized and, as represented at arrow 526 and block 528 a system ok lamp 192 is energized. As represented at arrow 530 and block 532, as the relay is latched the pneumatic tank valve functions described in connection with FIG. 11 at block 354 and 358 are activated as well as the fill and shut off valve functions represented at blocks 368 and 370. In this regard, arrow 534 is seen to extend to block 536 indicating the actuation of the tank valves, and arrow 538 is seen to extend to block 540 indicating the enablement of the emergency shut off valve functions as described at blocks 368 and 370 in conjunction with FIG. 11. Additionally, with the closure of the pressure responsive switch and latching of the relay, as represented at arrow 542 and block 544, the pump motors represented at block 344 in FIG. 11 are enabled.

When an emergency transmission has been received, then the query posed at block 522 will result in a negative determination and, as represented at arrow 546 and block 548 the relay function 292 will be opened to disenable gas pressure control monitor or pressure switch function 322 to create an off condition and, in turn, a system down condition. Under this condition the motor starter function 150 is disabled, the relay function 292 is released or unlatched and the electrically controlled valve or solenoid valve function 314 is de-energized to vent the conduit assembly as represented at dashed line 318 in FIG. 10.

The receiver circuit on condition as represented at block 508 also provides for the carrying out of two additional control functions as represented at arrow 548 and node A which reappears in FIG. 15. Referring to FIG. 15, arrow 550 is seen to extend from node A to block 552 providing for the poling of transmitters as at 212-220 to determine whether a supervisory coded transmission from them has failed to occur. This poling function proceeds, as represented at arrow 554 and block 556 to determine whether or not a faulty transmitter has been detected. In the event it has, then as represented at arrow 558 and block 560 a device fault cue as described in conjunction with block 194 in FIG. 10 is activated or turned on. Where no fault is determined as a consequence of the poling process, then as represented at arrow 562 and block 564 a determination is made as to whether any one or more of the emergency shut down transmitters 212–220 has transmitted an off-state signal. In the event that it has not, then as represented at arrow 566, this function dwells. However, where the transmitted off-state signal has occurred, then as represented at arrow 568 and block 570, the receiver circuit 508 de-energizes the electrical controlled or solenoid valve function 314 to cause the venting of the pneumatic conduit assembly as represented at dashed line 318 in FIG. 10. This also de-energizes the relay function 292 as represented in FIG. 10 as the venting occurs to open the switching function of the gas pressure control monitor 322. Then, as represented at arrow 572 and block 574 the system is down. The system then reverts as represented at arrow 576 and node B. Node B reappears in FIG. 14 in conjunction with arrow 578 extending to arrow 496 wherein the system again awaits the operator depression of the start or reset switch 188;

Since certain changes may be made in the above-described system and method without departing from the scope of the invention herein involved, it is intended that all matter contained in the above description or shown in the accompanying drawings shall be interpreted as illustrative and not in a limiting sense.

What is claimed is:

1. A system for controlling a hazardous fluid distribution facility having a perimeter with an entrance, an electrical power input, a source of gas under pressure, a principal fluid storage tank, a tank valve pneumatically actuable to provide fluid flow communication with said principal fluid storage tank and having a closed state in the absence of said actuation, a fluid pump in fluid flow communication with said tank valve, and a motor coupled to drive said fluid pump when enabled, comprising:

a start switch connectible with said electrical power input and actuable to provide a system start output;

an electrically controllable valve coupled in gas flow relationship with said source of gas under pressure and responsive to an on-state input to apply gas under pressure from said source at a valve output, to effect the pneumatic actuation of said tank valve and effecting said tank valve closed state by venting said gas applied thereto in the absence of said on-state input;

a gas pressure control monitor responsive to the pressure of said gas from said valve output, having a system enable condition when said gas pressure is at an enable value and having an off condition when said gas pressure is lower than said enable value;

a control network responsive to said start switch system start output to provide said on-state input to said electrically controlled valve, and responsive in the presence of said gas pressure monitor enable condition and said on-state input to maintain said on-state input.

2. The system of claim 1 further comprising:

a power switch coupled with said electrical power input and actuable to provide an electrical power output and an off condition;

said start switch is coupled for response to said electrical power output;

said control network is responsive to said power switch off condition to cause said electrically controllable valve to effect said tank valve dosed state.

3. The system of claim 1 including:

a first cuing device perceptible in response to a first input representing a system down condition; and said control network is responsive to said gas pressure control monitor off condition in the presence of said system start input to provide said first input.

4. The system of claim 1 in which said control network is responsive to said gas pressure control monitor system enable condition to enable said motor.

5. The system of claim 1 further comprising:

a second cuing device perceptible in response to a second input representing a system ok condition; and said control network is responsive to said gas pressure control monitor system enable condition to provide said second input.

6. The system of claim 1 in which:

said gas pressure control monitor is effective to derive said system enable condition in the presence of a monitor enable condition; and said control network is responsive to said system start output to derive said monitor enable condition.

7. The system of claim 6 in which:

said control network comprises a receiver, responsive to a transmitted off-state signal to effect removal of said on-state input to said electrically controlled valve; and including a first transmitter having a transmitter switch manually actuable to effect transmission of said off-state signal to said control network receiver.

8. The system of claim 7 in which said first transmitter is located adjacent aid distribution facility perimeter entrance.

9. The system of claim 7 in which:

said first transmitter is configured to periodically transmit a first coded transmitter supervisory status signal; and said control network receiver is configured to periodically poll for detecting the presence of said first coded transmitter supervisory status signal and is responsive in the absence of a polled said first coded transmitter status signal to provide a first device fault signal.

10. The system of claim 9 further comprising:

a third cuing device perceptible in response to a third input representing a faulty transmitter; and said control network is responsive in the absence of a polled said first coded transmitter supervisory status signal to derive said third input.

11. The system of claim 2 in which said power switch is a key actuated switch.

12. The system of claim 7 further comprising a second transmitter located adjacent said principal fluid storage tank and having a transmitter switch manually actuable to effect transmission of said off-state signal to said control network receiver.

13. The system of claim 9 further comprising:

a second transmitter remotely spaced from said first transmitter having a transmitter switch manually actuable to effect transmission of said off-state signal to said control network receiver and being configured to periodically transmit a second coded transmitter supervisory status signal; and said control network receiver is configured to periodically poll for detecting the presence of said second coded transmitter supervisory status signal and is responsive in the absence of a polled said second coded transmitter supervisory status signal to provide a second device fault signal.

14. The system of claim 1 further comprising:

a source pressure monitor responsive to the pressure of gas at said source of gas under pressure, when enabled and having a fault condition when said gas pressure at said source of gas under pressure is at a value below a source threshold value;

a fourth cuing device perceptible in response to a fourth input representing a low gas pressure condition; and said control network is responsive to said source pressure monitor fault condition to derive said fourth input.

* * * * *